US009014586B2

(12) United States Patent
Ooyanagi

(10) Patent No.: US 9,014,586 B2
(45) Date of Patent: Apr. 21, 2015

(54) IMAGE PROCESSING APPARATUS AND CONTROLLING METHOD FOR CONTROLLING A FIXING TEMPERATURE

(75) Inventor: Maho Ooyanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 238 days.

(21) Appl. No.: 13/609,778

(22) Filed: Sep. 11, 2012

(65) Prior Publication Data

US 2013/0084092 A1 Apr. 4, 2013

(30) Foreign Application Priority Data

Sep. 30, 2011 (JP) ..... 2011-217335

(51) Int. Cl.
*G03G 15/20* (2006.01)

(52) U.S. Cl.
CPC ..... *G03G 15/205* (2013.01); *G03G 15/2039* (2013.01); *G03G 2215/209* (2013.01)

(58) Field of Classification Search
CPC ..... G03G 15/205; G03G 15/2039; G03G 2215/209
USPC ..... 399/69, 82, 85
See application file for complete search history.

(56) References Cited

U.S. PATENT DOCUMENTS

| | | | |
|---|---|---|---|
| 5,918,087 | A | 6/1999 | Kimura et al. |
| 7,697,878 | B2 | 4/2010 | Condello et al. |
| 2003/0095807 | A1 | 5/2003 | Fujimori et al. |
| 2006/0029445 | A1 | 2/2006 | Nakamura et al. |
| 2009/0269108 | A1 * | 10/2009 | Condello et al. |
| 2013/0209127 | A1 * | 8/2013 | Fujimoto et al. ..... 399/69 |

FOREIGN PATENT DOCUMENTS

| | | | |
|---|---|---|---|
| JP | 10-39673 | A | 2/1998 |
| JP | 11-143290 | A | 5/1999 |
| JP | 2004-133039 | A | 4/2004 |
| JP | 2009265669 | A | 11/2009 |

OTHER PUBLICATIONS

Chinese Office Action dated Oct. 23, 2014, issued in counterpart Chinese Application No. 201210374873.X, and English-language translation thereof.

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image processing apparatus controls a fixing temperature of a fixing device which fixes an image to be formed. The apparatus obtains an attribute of each page included in a print job including a plurality of pages. Then, the apparatus controls a fixing temperature for each page, based on a change of the obtained attribute by the obtaining unit between continuous pages. In a case where there is a change of a printing mode between the continuous pages, the apparatus sets a fixing temperature of a preceding page according to the change close to a fixing temperature of a following page.

15 Claims, 15 Drawing Sheets

| MODE | FIXING TEMPERATURE |
|---|---|
| FULL COLOR HIGH QUALITY PRINTING MODE | T1 |
| FULL COLOR PRINTING MODE | T2 |
| SINGLE COLOR PRINTING MODE | T3 |
| SINGLE COLOR CHARACTER PRINTING MODE | T4 |

FIG.4

IMAGE PROCESSING APPARATUS AND CONTROLLING METHOD FOR CONTROLLING A FIXING TEMPERATURE

BACKGROUND OF THE INVENTION

1. Field of the Invention

The present invention relates to an image processing apparatus, a controlling method, and a program for controlling a fixing temperature when a toner image is fixed onto a recording paper.

2. Description of the Related Art

In an image forming apparatus that thermally fixes a toner image formed by electrophotography onto a recording paper, normally, the fixing temperature of a fixing unit is determined according to the amount per unit area of coloring material placed on a recording paper. For example, the maximum value of the amount of coloring material per unit area is determined in advance and the fixing temperature for fixing an image is adjusted so that the amount of coloring material per unit area is smaller than or equal to the maximum value.

A full-color copying machine forms an image by superimposing a plurality of color materials such as YMCK (yellow, magenta, cyan, and black), so that the amount of color materials (hereinafter referred to as the amount of tonner) placed on a recording paper tends to increase. Therefore, the thermal capacity of a fixing roller increases. In this case, just after powering on of the machine or just after the sleep state of the machine ends, the temperature of the fixing roller is lower than a predetermined fixing temperature, so that it is necessary to warm the fixing roller up to the predetermined fixing temperature. Therefore, there is a problem that there is a waiting time until printing starts. When outputting an image where the amount of toner is significantly lower than the assumed maximum value of the amount of toner, for example, when outputting an image in a monochrome mode using only a color material of color K, excessive heating is performed, depending on an image to be output, so that there are problems, such as useless power consumption and curling of transfer paper.

To solve the above problems, as a related art, Japanese Patent Laid-Open No. H10-039673 (1998) discloses a technique for correcting the fixing temperature according to the image contents of images to be printed, such as characters and photos on one page.

SUMMARY OF THE INVENTION

However, according to the above related art, the fixing temperature is changed for each page, so that if there is a page printed with a high fixing temperature after a page is printed with a low fixing temperature, it is necessary to raise the fixing temperature from a low temperature to a high temperature. Therefore, there is a problem that the larger the difference of the fixing temperatures, the longer the waiting time.

An object of the present invention is to suppress the change of the fixing temperature for each page and prevent the decline of productivity in printing.

To solve the above problems, an image processing apparatus for controlling a fixing temperature of a fixing device which fixes an image to be formed comprises an obtaining unit configured to obtain an attribute of each page included in a print job including a plurality of pages, and a controlling unit configured to control a fixing temperature for each page, based on a change of the obtained attribute obtained by the obtaining unit between continuous pages.

According to the present invention, the change of the fixing temperature between pages is suppressed, so that it is possible to reduce the time for adjusting the fixing temperature for each page and improve the productivity of printing.

Further features of the present invention will become apparent from the following description of exemplary embodiments (with reference to the attached drawings).

BRIEF DESCRIPTION OF THE DRAWINGS

FIG. 4 is a diagram showing a relationship between printing mode and fixing temperature;

DESCRIPTION OF THE EMBODIMENTS

First Embodiment

Hereinafter, the best mode for carrying out the present invention will be described with reference to the drawings.

Figure 1:
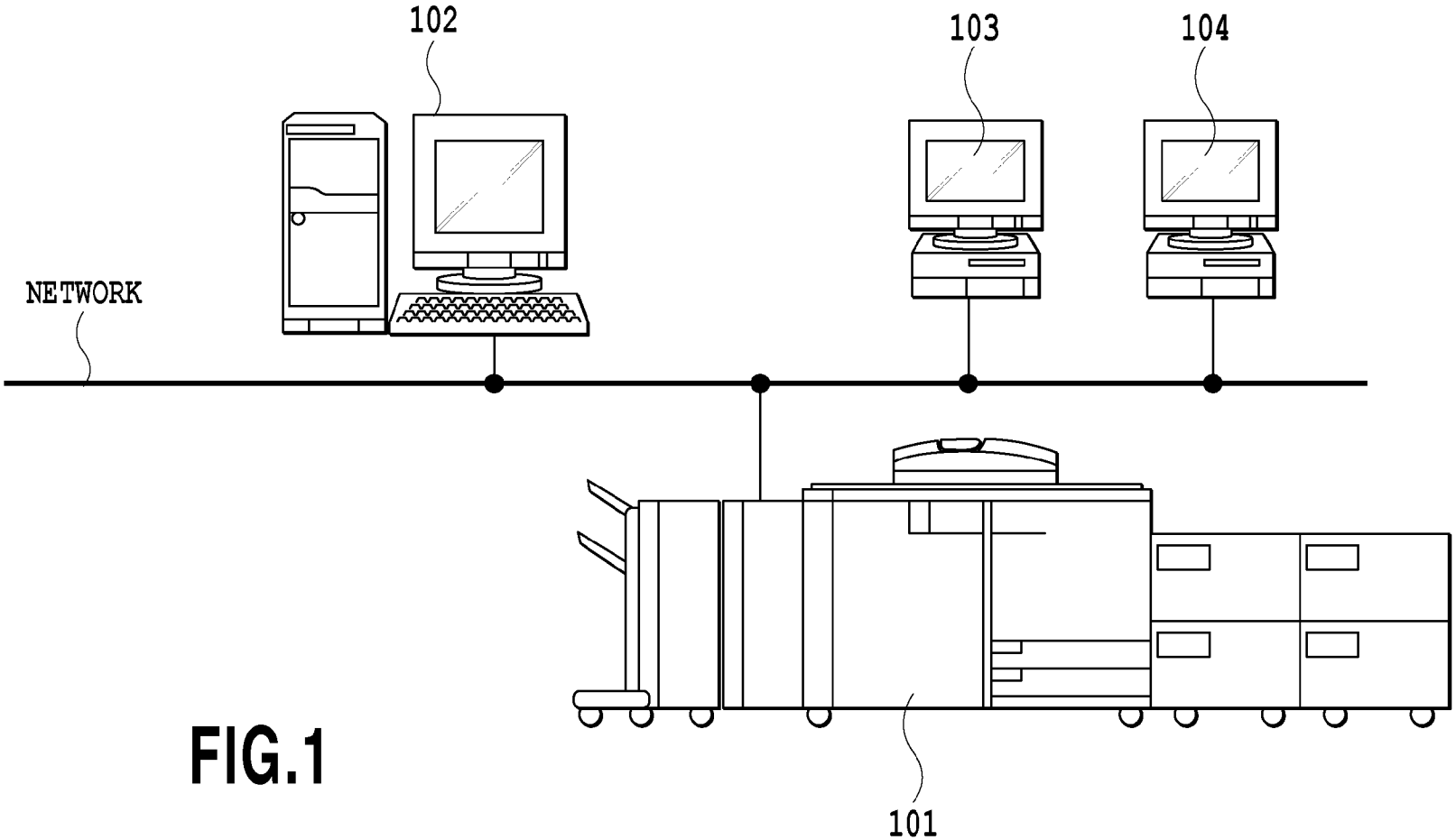
FIG. 1 is a diagram showing an example of a configuration of an image forming system according to an embodiment.

FIG. 1 is a diagram showing an example of a configuration of an image forming system according to the present invention.

An image forming apparatus 101 processes various input data, performs image formation (image generation), and outputs printed objects. The image forming apparatus 101 includes a fixing unit that thermally fixes a toner image, which is formed by electrophotography, onto a recording paper on a page by page basis. The image forming apparatus 101 is configured to perform a fixing operation when the temperature of the fixing unit reaches a predetermined temperature. A print server 102 is connected to each apparatus via a network. In the same manner as the print server 102, client PCs 103 and 104 are also connected to each apparatus via a network.

[Configuration of Image Forming Apparatus]

Figure 2:
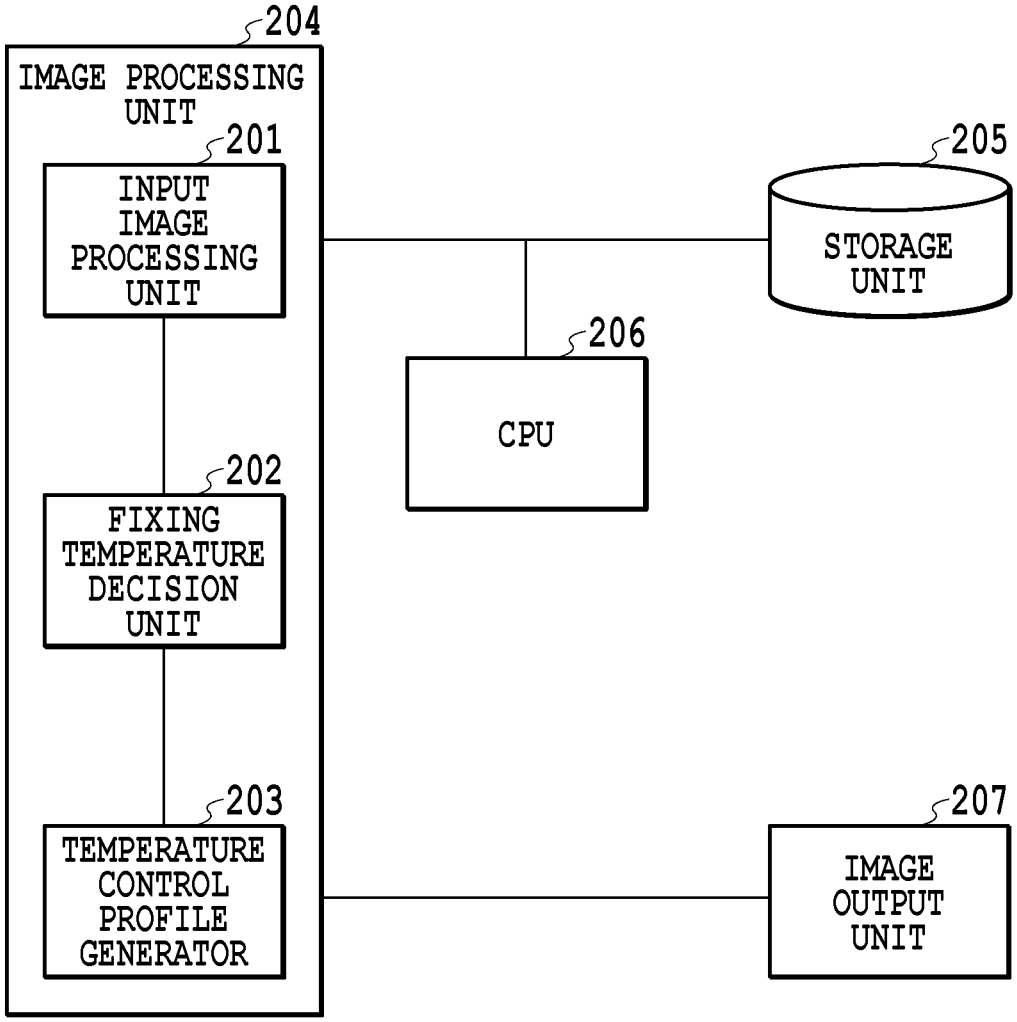
FIG. 2 is a block diagram showing a configuration of an image forming apparatus according to a first embodiment.

FIG. 2 is a block diagram showing a configuration of the image forming apparatus 101.

As shown in FIG. 2, the image forming apparatus 101 includes an image processing unit 204, a storage unit 205, a CPU 206, and an image output unit 207. The image processing unit 204 includes an input image processing unit 201, a fixing temperature decision unit 202, and a temperature control profile generator 203. In the present embodiment, an apparatus including the image processing unit 204, the storage unit 205, and the CPU 206 is defined as an image forming apparatus.

The storage unit 205 includes a ROM, a RAM, a hard disk device (HDD), and the like. The ROM stores various control programs and image processing programs executed by the CPU 206. The RAM is used as a reference area and a work area in which the CPU 206 stores data and various information.

The RAM and the HDD are used as a storage or the like for an object buffer described later, a temperature control profile buffer described later, and the like. Image data is accumulated on the RAM and the HDD. Pages are sorted and images across a plurality of sorted pages are accumulated in the RAM and the HDD, so that a plurality of pages is printed out.

The image output unit 207 forms a color image and/or a monochrome image on a recording medium such as a recording paper and outputs the recording medium.

Figure 9:
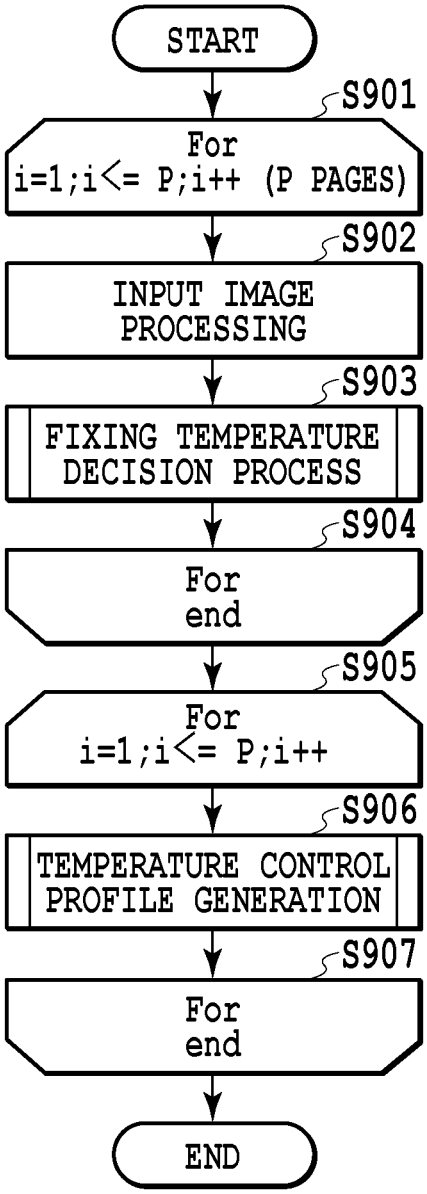
FIG. 9 is a flowchart showing a processing procedure for generating a temperature control profile according to the first embodiment.

Next, a processing procedure for generating a temperature control profile according to the present embodiment will be described with reference to a flowchart shown in FIG. 9.

First, in step S901, a variable i related to processes from step S902 to step S904 is defined. The variable i represents the number of pages related to a print job.

First, i is set to one and processes in S902 and S903 are repeated while incrementing i by one until i becomes P (the total number of pages related to a job).

In step S902, the image processing unit 204 converts print information including image data, which is input from an external apparatus (for example, the print server 102 or the client PC 103 or 104) to the input image processing unit 201, into intermediate information (hereinafter referred to as "object"). The image processing unit 204 stores the object in an object buffer in the storage unit 205. Further, the image processing unit 204 generates bit map data on the basis of the stored object and stores the bit map data in a buffer in the storage unit 205. At this time, the image processing unit 204 determines an attribute of the object by analyzing the bit map data and performs a color conversion process, an image adjusting process, and the like on the bit map data on the basis of the determined attribute. The image processing unit 204 transmits the attribute of the object and information for the color conversion process to the fixing temperature decision unit 202.

In step S903, the fixing temperature decision unit 202 determines a fixing temperature to print an image for i page related to the print job on the basis of the attribute of the object and the information for the color conversion process received from the input image processing unit 201. The details of the process for determining the fixing temperature will be described later. Further, the fixing temperature decision unit 202 stores fixing temperatures for each page output in one print job in a fixing temperature buffer in the storage unit 205.

In the same manner as in step S901, in step S905, a variable i used in the processes of step S906 and step S907 is defined.

In step S906, the temperature control profile generator 203 acquires the fixing temperatures determined in S903 for all pages in the print job from the fixing temperature buffer. The temperature control profile generator 203 generates a temperature control profile in which optimal fixing temperatures are determined based on the viewpoint of the productivity of printing and the quality of image and stores the temperature control profile in the temperature control profile buffer in the storage unit 205. The details of the generation of the temperature control profile will be described later.

[Schematic View of Image Forming Apparatus]

Figure 3:
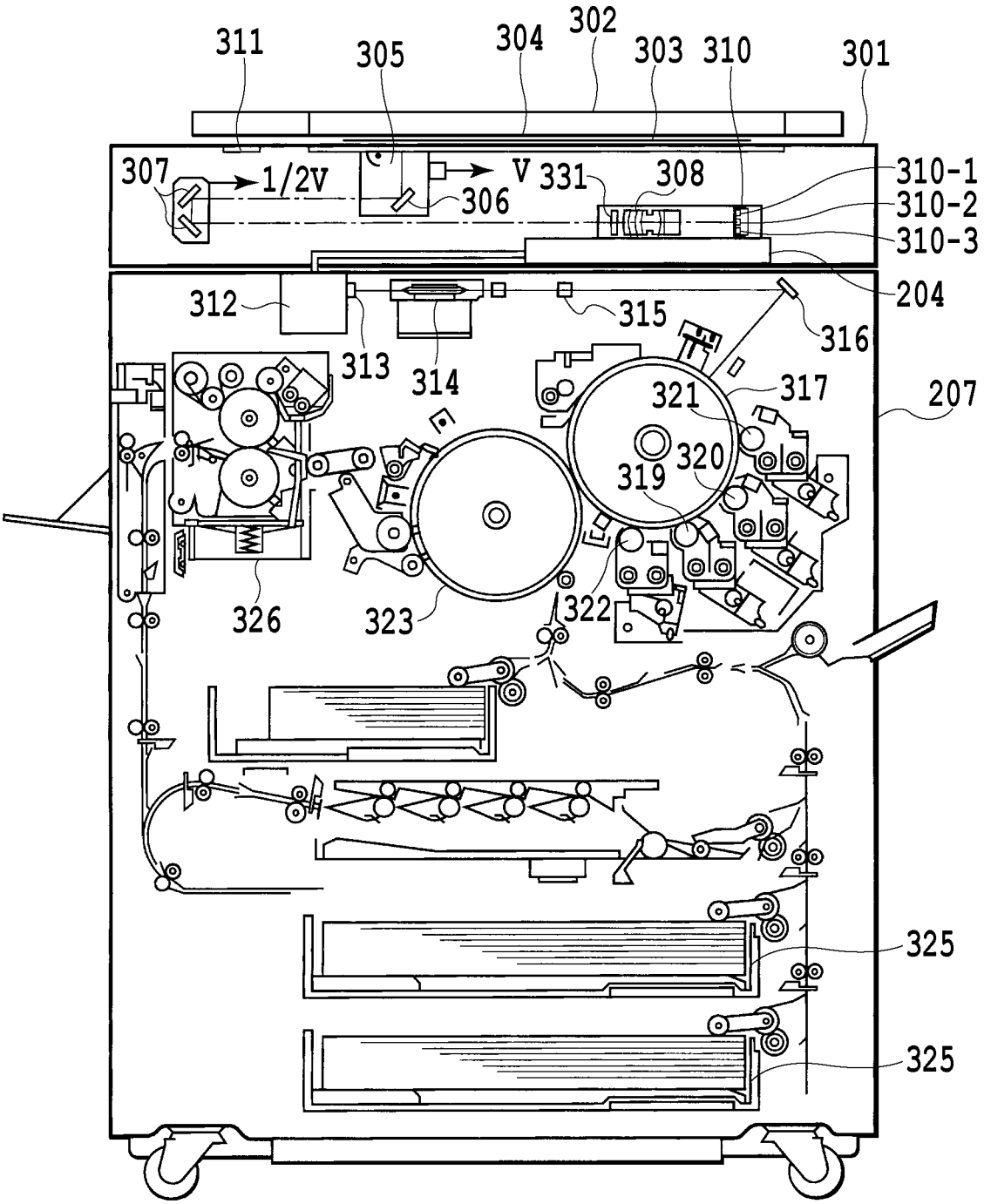
FIG. 3 is a diagram showing a schematic view of the image forming apparatus.

FIG. 3 is a diagram showing a schematic view of the image forming apparatus 101.

An image reading unit 301 optically reads a document 304 placed between a platen glass 303 and a document pressing plate 302. At this time, the document 304 is irradiated with light of a lamp 305. Light reflected from the document 304 is formed into an image on a 3-line sensor 310 by a lens 308 via mirrors 306 and 307.

An infrared cut filter 331 is provided to the lens 308. An unillustrated motor moves a mirror unit including the mirror 306 and the lamp 305 at a velocity V and moves a mirror unit including the mirror 307 at a velocity V/2 in a direction indicated by arrows. In other words, the mirror units move in a direction (sub-scanning direction) perpendicular to an electrical scanning direction (main scanning direction) of the 3-line sensor 310, so that the entire surface of the document 304 can be scanned.

The 3-line sensor 310 including three lines of CCDs separates colors of input light information, reads color components of red R, green G, and blue B of full color information, and transmits color component signals to the image processing unit 204. Each of the CCDs constituting the 3-line sensor 310 has light receiving elements corresponding to 5000 pixels and can read an A3 size document, which is the maximum size of a document that can be placed on the platen glass 303, in a short direction (297 mm) at a resolution of 600 dpi.

A standard white plate 311 is a plate for correcting data read by CCDs 310-1, 310-2, and 310-3 of the 3-line sensor 310. The standard white plate 311 has a white color having substantially uniform reflectance property in visible light.

The image processing unit 204 electrically processes image signals input from the 3-line sensor 310, generates color component signals of yellow Y, magenta M, cyan C, and black K, and transmits the generated color component signals of YMCK to an image output unit 207. The image output at this time is a YMCK image on which a halftone process, such as dither, is performed.

In the image output unit 207, the image signal of Y, M, C, or K transmitted from the image reading unit 301 is transmitted to a laser driver 312. The laser driver 312 drives and modulates a semiconductor laser device 313 according to the input image signal. A laser beam output from the semiconductor laser device 313 scans on a photosensitive drum 317 via a polygon mirror 314, an f-θ lens 315, and a mirror 316 and forms an electrostatic latent image on the photosensitive drum 317.

A developing unit includes a yellow developing unit 319, a magenta developing unit 320, a cyan developing unit 321, and a black developing unit 322. The four developing units come into contact with the photosensitive drum 317 in turns, so that an electrostatic latent image formed on the photosensitive drum 317 is developed by toner of a corresponding color and a toner image is formed. A recording paper supplied from a recording paper cassette 325 is wrapped around a transfer drum 323 and the toner image on the photosensitive drum 317 is transferred to the recording paper.

The recording paper, on which the toner images of four colors Y, M, C, and K are sequentially transferred, passes through a fixing unit 326, so that the toner images are fixed to the recording paper and then the recording paper is discharged to the outside of the apparatus. The fixing unit 326 fixes the toner images of four colors Y, M, C, and K to the recording paper by applying pressure and heat from an internal pressure roller to the recording paper. At this time, if the amount of heat is insufficient to the amount of toner, poor fixation occurs and a normal image cannot be obtained, so that a temperature sensor, not shown in the drawings, is attached to the fixing unit and it is controlled so that the fixing operation is performed only when a temperature sufficient to perform the fixing operation is confirmed. The temperature control is performed by the CPU 206 using a relationship between the fixing temperature and the temperature sensor information generated by the temperature control profile generator 203 on the basis of information on the fixing temperature determined by the fixing temperature decision unit 202.

Although, in the present embodiment, the image reading unit 301 is mounted, the present invention can be applied to a configuration of the image processing unit 204 and the image output unit 305.

Next, the process of the fixing temperature decision unit 202 will be described.

The fixing temperature decision unit 202 determines, according to the type of printing mod; a fixing temperature of a fixation operation by the fixing unit 326. The reason why the fixing temperature is determined according to the type of printing mode is that the amount of toner per unit area on an image varies depending on the type of printing mode and the temperature to fix the toner to the recording paper varies accordingly.

Here, the amount of toner means the amount of toner per unit area on an image, and % is used as a unit of the amount of toner. Specifically, when the maximum value of each color of Y, M, C, and K is defined as 100%, for example, if two colors of the maximum value are overlapped, the amount of toner in the overlapped area is defined as 200%. Each color has a gradation, so that each color may take a value from 0% to 100%.

Next, as an example of printing modes, four printing modes will be described with reference to FIG. 4. Also, a relationship between the amount of toner and the fixing temperature in each printing mode will be described.

A full color high quality printing mode is a mode in which four color toners of YMCK are fully used, any color is reproduced in a range in which the color can be reproduced by the toner of the color, and high quality color printing is performed. Therefore, the maximum amount of toner at that time is about 240%, which is necessary and sufficient. The full color high quality printing mode is a mode for performing high quality color printing, so that it is necessary to put importance on the gloss property of an image that can vary depending on the fixing temperature, needless to say about the capability to fix the maximum amount of toner of 240% to the recording paper. Therefore, the highest fixing temperature is required and used in the full color high quality printing mode among the four printing modes.

A full color printing mode is a mode in which four color toners of YMCK are fully used, any color is reproduced in a range in which the color can be reproduced by the toner of the color, and color printing is performed. In the same manner as in the full color high quality printing mode, the maximum amount of toner at that time is about 240%, which is necessary and sufficient. However, high quality printing is not required, so that it is not necessary to put importance on the gloss property. Therefore, an image is fixed at the second highest fixing temperature next to the fixing temperature of the full color high quality printing mode.

A single color printing mode is a printing mode in which only a single color toner is used as in the monochrome printing. Therefore, the maximum value of the amount of toner is 100%. In this mode, not only characters, but also photos are printed with a single color, so that the number of pixels where the toner is used in one transfer paper is relatively large. Therefore, an image is fixed to a transfer paper at a temperature higher than a temperature of a single color character printing mode described below but lower than the temperature of the full color printing mode.

A single color character printing mode is a printing mode in which only a single color toner is used in the same manner as in the single color printing mode, so that the maximum value of the amount of toner is 100%. However, the single color character printing mode is used to perform printing in which a single color is used and no photo is printed, so that the number of pixels where the toner is used in one transfer paper is relatively small. Therefore, an image is fixed to a transfer paper at a temperature lower than the temperature of the single color printing mode.

In this way, the fixing temperature is set to be different for each of the four printing modes. Here, when the fixing temperature of the full color high quality printing mode is T1, the fixing temperature of the full color printing mode is T2, the fixing temperature of the single color printing mode is T3, and the fixing temperature of the single color character printing mode is T4, the relationship of the four temperatures is T1>T2>T3>T4. FIG. 4 is a table showing a relationship of the above. The fixing temperature decision unit stores the fixing temperatures corresponding to each printing mode in the storage unit 205 in order to determine a fixing temperature corresponding to a printing mode.

In the present embodiment, the a period of time required to change the fixing temperature by one step, such as from the state of T1 to the state of T2, from the state of T2 to the state of T3, and from the state of T3 to the state of T4, is set to be within t1. Here, t1 is a period of time from when a paper sheet is discharged from the fixing unit 326 to when the next paper sheet is input into the fixing unit 326 (the period of time is referred to as a time between sheets).

Figure 5:
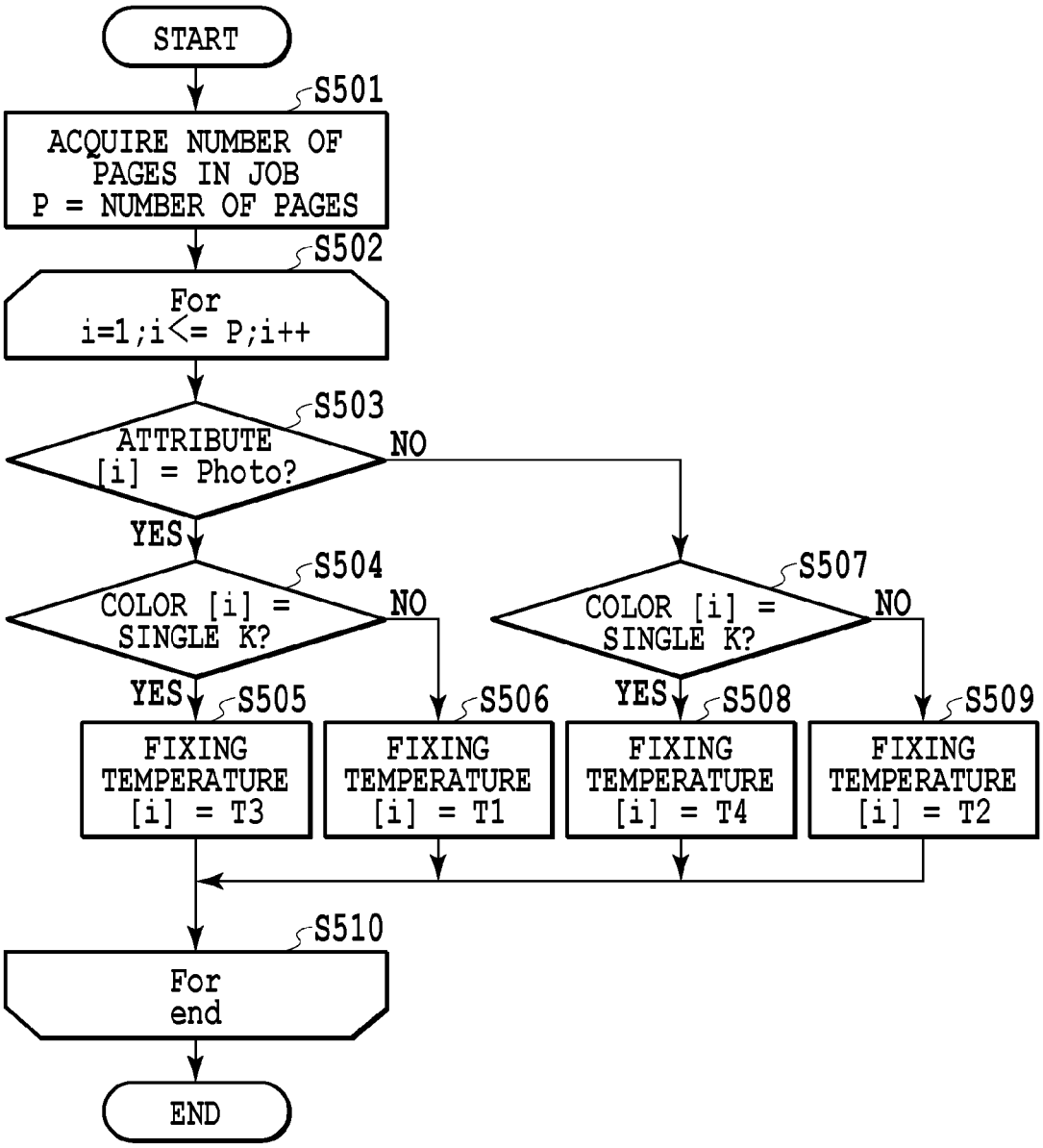
FIG. 5 is a flowchart showing a processing procedure of a fixing temperature decision unit.

Next, the processing procedure of the fixing temperature decision unit 202 will be described with reference to a flowchart in FIG. 5. The processing procedure shown in FIG. 5 is performed by the fixing temperature decision unit 202 on the basis of a command from the CPU 206. The processing corresponds to a process of S903 shown in FIG. 9.

First, image data is input from an external apparatus to the input image processing unit 201, and thereafter, in step S501, the CPU 206 acquires a total number of pages (P pages) related to a print job and stores the total number of pages in a page number buffer in the storage unit 205.

Next, in step S502, a fixing temperature decision process is repeatedly performed for each i page in the P pages acquired in step S501.

In step S503, the CPU 206 determines whether or not the attribute of the image processed by the input image processing unit 201 includes "Photo" for i page.

In step S504, the CPU 206 determines whether or not an image determined to be "image including Photo attribute" in step S503 is an image of a single color of K from a color process result processed by the input image processing unit 201.

In step S505, the CPU 206 determines the fixing temperature of the corresponding page to be T3 and stores the fixing temperature T3 associated with i page in the fixing temperature buffer in the storage unit 205.

In step S506, the CPU 206 determines the fixing temperature of the corresponding page to be T1 and stores the fixing temperature T1 associated with i page in the fixing temperature buffer in the storage unit 205.

In step S507, the CPU 206 determines whether or not an image determined to be "image not including Photo attribute" in step S503 is an image of a single color of K from the color process result processed by the input image processing unit 201.

In step S508, the CPU 206 determines the fixing temperature of the corresponding page to be T4 and stores the fixing temperature T4 associated with i page in the fixing temperature buffer in the storage unit 205.

In step S509, the CPU 206 determines the fixing temperature of the corresponding page to be T2 and stores the fixing temperature T2 associated with i page in the fixing temperature buffer in the storage unit 205.

In step S510, the CPU 206 determines whether or not the processes described above are repeated as many times as the number of pages stored in the page number buffer in the storage unit 205, and if the processes are completed for all the pages, the flow shown in FIG. 5 is completed.

The printing mode and the fixing temperature corresponding to the printing mode in each page are determined according to the processing procedure described above.

Figure 7:
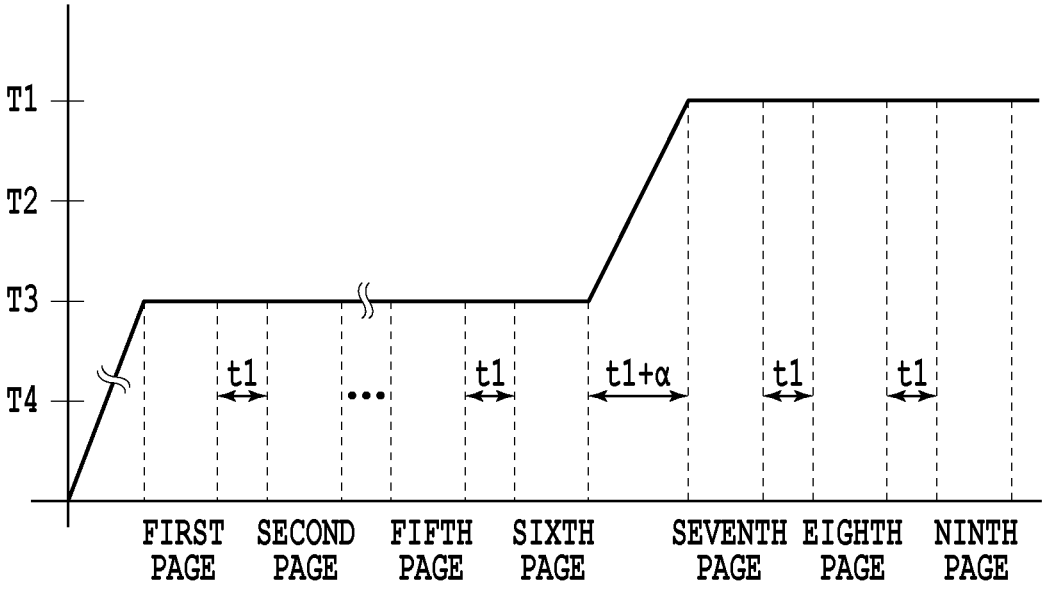
FIG. 7 is a diagram showing an example of fixing temperature for each page determined by the fixing temperature decision unit.

For example, FIG. 7 shows an example of the fixing temperatures of each page determined by the fixing temperature decision unit 202 when the pages from the first page to the sixth page are the single color printing mode and the seventh and the subsequent pages are the full color high quality printing mode.

In the related art, the temperature of the fixing unit 326 is set on the basis of the fixing temperature of each page determined by the fixing temperature decision unit 202, so that there may be a problem that down time occurs.

The down time occurs when the fixing temperature changes two steps or more, for example, as shown in FIG. 7, when the fixing temperature changes two steps between the sixth page and the seventh page. To avoid such a rapid change of the fixing temperature, a process performed by the temperature control profile generator 203, which is a feature of the present embodiment, is required.

Next, the process of the temperature control profile generator 203 will be described. This process corresponds to the temperature control profile generation process in S906.

The temperature control profile generator 203 generates an optimal temperature control profile from the viewpoint of productivity of print job and quality of image on the basis of the fixing temperatures set for all the pages of the print job determined by the fixing temperature decision unit 202.

For example, a case will be described in which, in a print job, after a plurality of print pages is continuously printed by the single color printing mode, there is a print page by the full color high quality printing mode. In this case, when changing the printing mode from the single color printing mode to the full color high quality printing mode, the fixing temperature needs to be changed by two steps. However, to raise the fixing temperature by two steps, a period of time of $t1+\alpha$ is required, so that the required time is longer than that when raising the fixing temperature by one step.

Conventionally, the printing is stopped until the temperature of the fixing unit rises to a desired temperature and the printing is started when the temperature of the fixing unit reaches the desired temperature, so that the productivity of the printing declines (that is, the down time occurs).

Therefore, the temperature control profile generator 203 of the present embodiment generates a temperature control profile considering continuity and order of the fixing temperatures of the pages in the job and improves the productivity and furthermore the power consumption.

Figure 6:
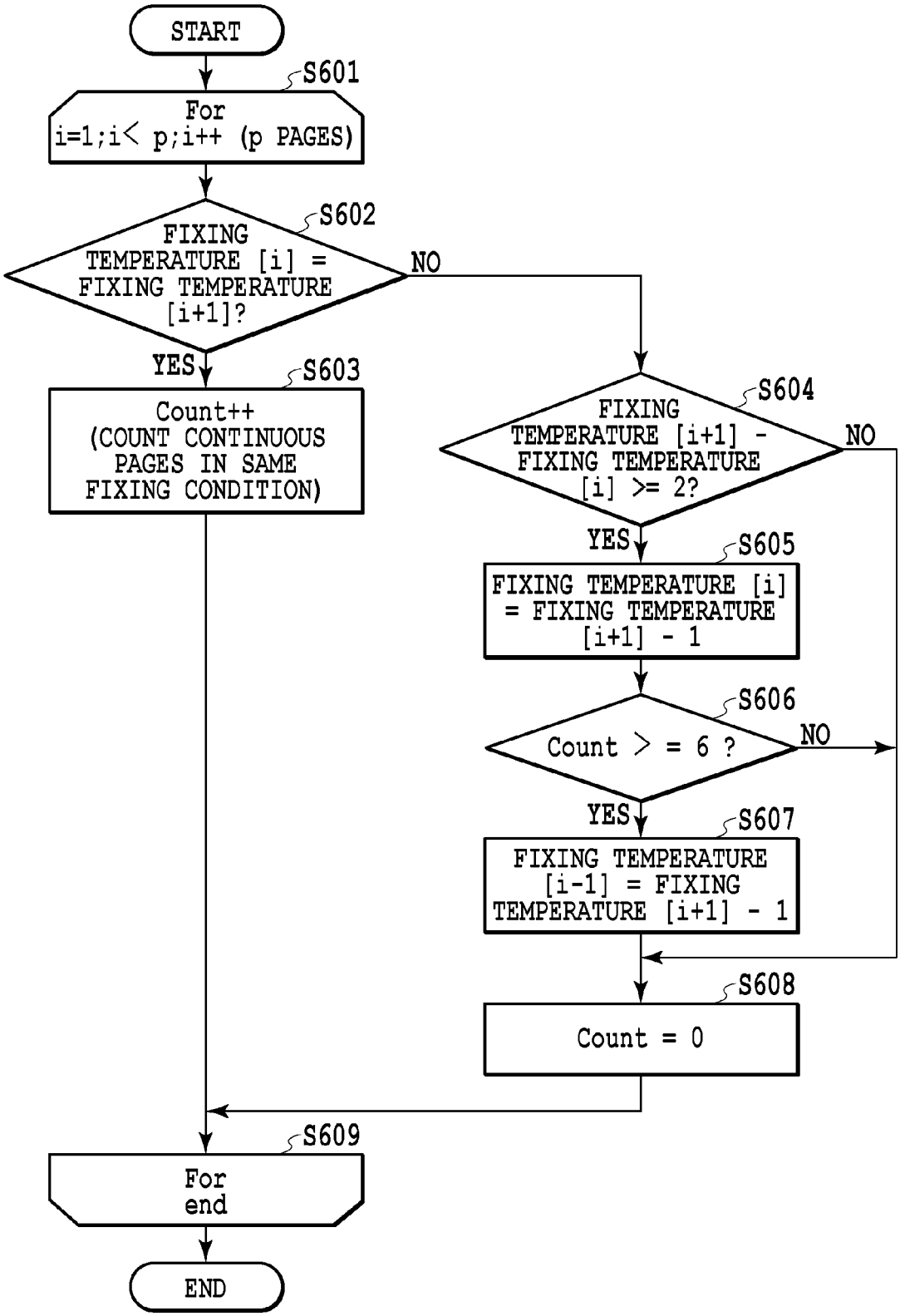
FIG. 6 is a flowchart showing a processing procedure of a temperature control profile generator.

Next, a specific process of the temperature control profile generator 203 will be described with reference to FIG. 6.

In step S601, for all the pages of the job which are determined by the fixing temperature decision unit 202 and read from the fixing temperature buffer in the storage unit 205, the following process is repeated: The i page is selected and a process is performed for each i page.

First, in step S602, the CPU 206 determines whether or not the fixing temperature of the i page (first page) to be a target and the fixing temperature of the next i+1 page (second page) are the same. If the fixing temperatures are the same (S602; YES), in S603, the CPU 206 determines how many continuous pages after the i page have the same fixing temperature as that of the i page on the basis of the fixing temperature of the i page. On the other hand, if the fixing temperatures are not the same (S602; NO), the CPU 206 proceeds to step S604.

In step S604, the CPU 206 determines whether or not the difference between the fixing temperature of the i page and the fixing temperature of the next i+1 page is two steps or more when the fixing temperatures shown in FIG. 4 are defined as four steps. In other words, whether or not the difference is greater than or equal to a predetermined value is determined. In step S604, if the CPU 206 determines that the difference between the fixing temperatures is two steps or more (S604; YES), the CPU 206 proceeds to step S605. On the other hand, if the CPU 206 determines that the difference between the fixing temperatures is smaller than two steps (S604; NO), the CPU 206 proceeds to step S608. In step S604, the CPU 206 may determine whether or not the difference between the fixing temperature of the i page and the fixing temperature of the next i+1 page is greater than or equal to a predetermined temperature. In step S604, if the CPU 206 determines that the difference is greater than or equal to the predetermined temperature, the CPU 206 proceeds to step S605. If the CPU 206 determines that the difference is smaller than the predetermined temperature, the CPU 206 proceeds to step S608 and controls the fixing temperature without changing the fixing temperature of the i page determined by the fixing temperature decision unit 202.

In step S605, the CPU 206 sets the fixing temperature of the i page to a fixing temperature one step lower than the fixing temperature of the i+1 page. Then, the CPU 206 stores a temperature control profile, in which the fixing temperature newly set for the i page is associated with the i page, in the temperature control profile buffer in the storage unit 205.

For example, when the mode set for the i page is the single color printing mode and the mode set for the i+1 page is the full color high quality printing mode, the CPU 206 resets the fixing temperature to the fixing temperature of the full color printing mode, which is one step lower than the fixing temperature of the full color high quality printing mode. In short, the CPU 206 makes a schedule so that the fixing temperature is raised.

In step S606, the CPU 206 determines the printing modes before the i page. Specifically, the CPU 206 determines whether or not a predetermined number of continuous pages are the same printing mode as that of the i page for the pages before the i page.

Figure 8:
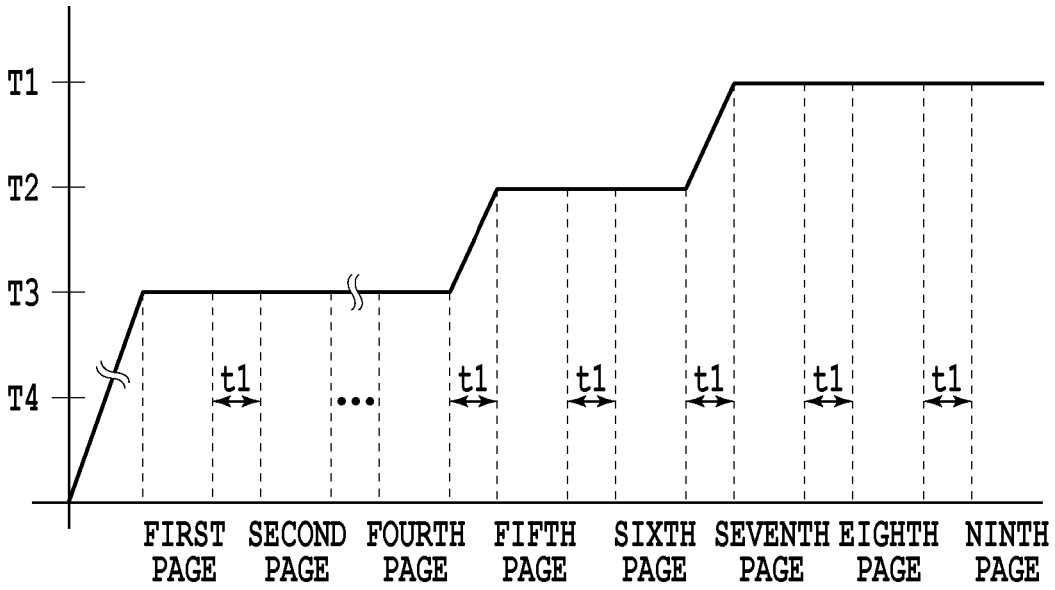
FIG. 8 is a diagram showing an example of fixing temperature determined for each page in a temperature control profile.

In step S607, if the result of S606 is YES, the CPU 206 sets the fixing temperature of the i−1 page to a fixing temperature one step lower than the fixing temperature of the i+1 page. For example, as shown in FIG. 7, a case will be described in which the pages from the first page to the sixth page are the single color printing mode and the seventh page is the full color high quality printing mode. Here, it is assumed that i=6 and the predetermined number described in S606 is six. In this case, as shown in FIG. 7, the predetermined number of six pages from the first page to the sixth page are the same printing mode, so that the fixing temperature of the fifth page is reset to a temperature one step lower than the fixing temperature of the seventh page. As a result, as shown in FIG. 8, the fixing temperatures of the fifth page and the sixth page are reset to a temperature one step lower than the fixing temperature of the seventh page. As a result, it is possible to reduce the period of time required to raise the temperature of the fixing unit from when the sixth page is fixed to when the seventh page is fixed.

In step S608, a counter used to measure the continuity of the fixing temperature is cleared.

In this way, a temperature control profile in which the fixing temperatures are reset and the reset fixing temperatures are associated with each page is generated.

In addition, it may be possible to determine a fixing temperature by using an attribute of each page included in a print job as a method of determining a fixing temperature for each page. Specifically, according to a change of an attribute between pages included in a print job, for example if the attribute of a page is changed from a monochrome page to a color page, the fixing temperature of a monochrome page which is the preceding page before a color page may be set to a temperature close to the fixing temperature of the color page. Accordingly, it can reduce down time when a printing page is changed from the monochrome page to the color page. Also, if there is no change of an attribute among pages included in a printing job, each of a fixing temperature is set to a predetermined fixing temperature which is set to each page. For example, if the attribute of each continuous page is set to the color attribute, the fixing temperature is set to the fixing temperature of the color page.

In addition, it may be possible to determine a fixing temperature by using a print mode of each page included in a print job as a method of determining a fixing temperature for each page. An example of a printing mode is for example shown in FIG. 4 as described above. Specifically, according to the change of a print mode between pages included in a print job, for example if the print mode of a page is changed from the single color printing mode to the full color high quality mode, it may be possible that the fixing temperature of a page of the single color printing mode which is the preceding page of the page of the full color high quality mode is set to a temperature close to the fixing temperature of the full color high quality mode. Accordingly, it can reduce down time when a printing page is changed from the page of the single color printing mode to the page of the full color high quality mode. Also, if there is no change of a printing mode among pages included in a printing job, each of a fixing temperature is set to the predetermined fixing temperature which is set to each page. For example, if the printing mode of each continuous page is set to the full color high quality mode, the fixing temperature is set to T1.

Figure 10:
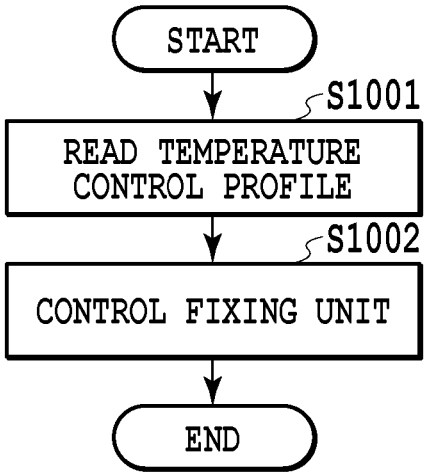
FIG. 10 is a flowchart showing a processing procedure for controlling the fixing temperature of a fixing unit according to the first embodiment.

Finally, the processing procedure of the temperature control according to the present embodiment will be described using FIG. 10.

In step S1001, the temperature control profile stored in the temperature control profile buffer in the storage unit 205 is read.

Next, in step S1002, the CPU 206 directs the fixing unit to have the fixing temperature set for each page for each page of the print job on the basis of the temperature control profile.

The fixing temperature of each page of the print job is controlled by this process, so that it is possible to perform efficient temperature control taking into account the productivity of the printing, the quality of the image, and the power consumption.

Second Embodiment

In the first embodiment, a temperature control profile is generated in which the fixing temperature of the fixing unit 326 is determined for each page is generated for a print job. The fixing unit is controlled according to the temperature control profile.

In the second embodiment, when a plurality of print jobs, each of which includes a plurality of pages, are performed, first, images of the first job are fixed to the transfer papers according to the processing procedure described in the first embodiment. In the processes of the second and the subsequent jobs, while using the temperature control profile generated when the first print job is performed, images are more accurately fixed to the transfer papers.

The reason why the above process is performed is that the transfer paper passing through the fixing unit absorbs heat when an image is fixed to the transfer paper, so that the temperature control of the fixing unit considering the absorbed heat is required.

A description of the same configurations and elements as those in the first embodiment will be omitted.

Figure 11:
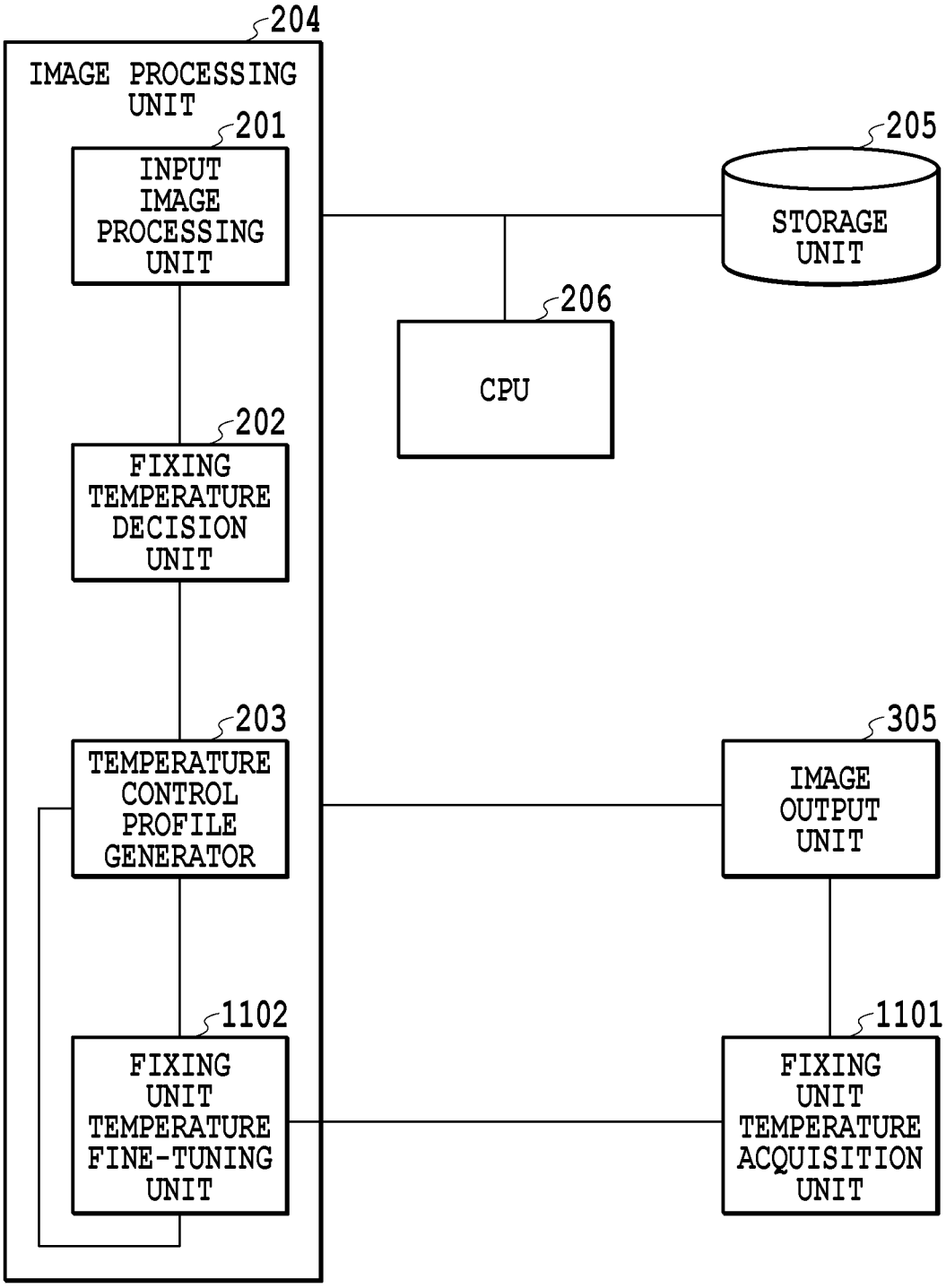
FIG. 11 is a block diagram showing a configuration of an image forming apparatus according to a second embodiment.

FIG. 11 is a block diagram showing a configuration of the image forming apparatus 101 according to the present embodiment. As shown in FIG. 11, the image processing unit 204 of the second embodiment further includes a fixing unit temperature acquisition unit 1101 and a fixing unit temperature fine-tuning unit 1102 in addition to the configuration of the first embodiment.

The fixing unit temperature acquisition unit 1101 acquires a temperature value as a measured temperature that is measured by a temperature sensor in the fixing unit 326 included in the image output unit 305.

The fixing unit temperature fine-tuning unit 1102 compares the temperature value acquired by the fixing unit temperature acquisition unit 1101 and the fixing temperature indicated by the temperature control profile, and when there is a difference between them, the fixing unit temperature fine-tuning unit 1102 changes the fixing temperature indicated by the temperature control profile.

Figure 12:
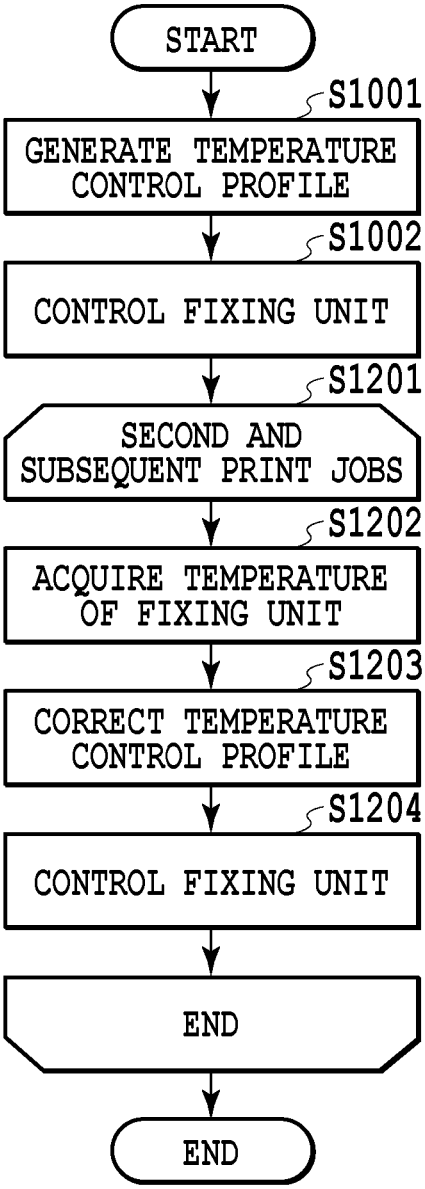
FIG. 12 is a flowchart showing a processing procedure for generating a temperature control profile according to the second embodiment.

Next, the processing procedure according to the second embodiment will be described with reference to a flowchart shown in FIG. 12.

Step S1001 and step S1002 are the same as those in the first embodiment, so that the description will be omitted. The present embodiment is an example in which a command related to the job is to print a plurality of copies of a document, so that the processes from step S1201 to step S1205 are processes for the second and the subsequent print jobs.

In step S1202, the fixing unit temperature acquisition unit 1101 acquires the temperature value of the fixing unit and stores the temperature value in a fixing unit temperature buffer in the storage unit 205.

In step S1203, a difference between the temperature value acquired by the fixing unit temperature acquisition unit 1101 and the fixing temperature indicated by the temperature control profile is calculated. Then, a correction value based on the difference is calculated and the correction value is stored in a correction value buffer in the storage unit 205. The CPU 206 updates the temperature control profile by adding the correction value to the fixing temperature in the temperature control profile in the storage unit 205. This updated temperature control profile is stored in the temperature control profile buffer in the storage unit 205.

Figure 13:
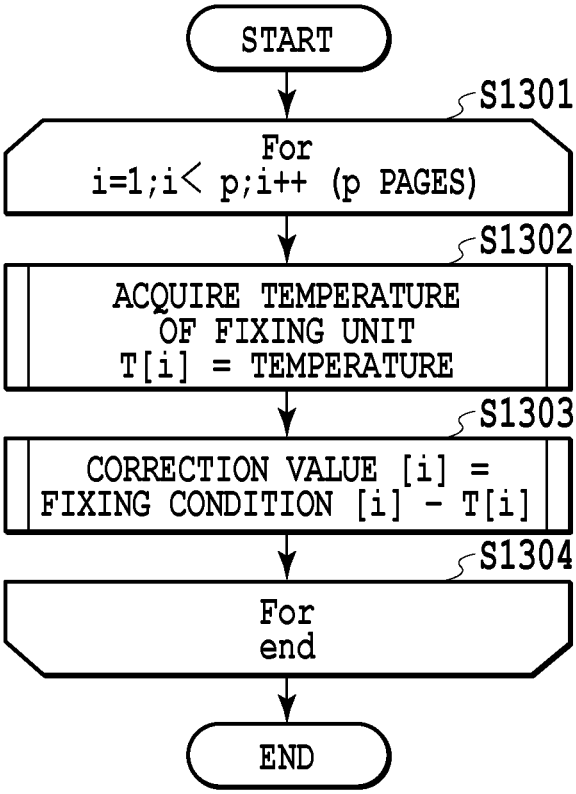
FIG. 13 is a flowchart showing a processing procedure of a fixing unit temperature acquisition unit and a fixing unit temperature fine-tuning unit according to the second embodiment.

Next, the processes of the fixing unit temperature acquisition unit 1101 and the fixing unit temperature fine-tuning unit 1102 will be described with reference to FIG. 13.

The processes from step S1301 to step S1304 are processes related to each page of the job.

In step S1302, the CPU 206 acquires the temperature value of the fixing unit 326 from the fixing unit temperature acquisition unit 1101.

In step S1303, the CPU 206 calculates a difference between the fixing temperature specified by the temperature control profile for the i page and the temperature value of the fixing unit 326 acquired in step S1302 and stores the difference value in the correction value buffer in the storage unit 205 as a correction value.

Next, an example of the process in the present embodiment will be described with reference to FIGS. 8, 14, and 15.

For example, a case will be described, in which a plurality of print jobs, in each of which pages from the first page to the sixth page are the single color printing mode and the seventh and the subsequent pages are the full color high quality printing mode as shown in FIG. 7 in the first embodiment, are performed. First, in the first job, the temperature control of the fixing unit 326 is performed according to the temperature control profile shown in FIG. 8.

However, as described above, when a transfer paper passes through the fixing unit 326, the transfer paper takes the heat of the fixing unit 326, so that the amount of the heat taken away needs to be known. Therefore, while the first print job is performed, the temperature value of the fixing unit 326 is acquired for each page by the temperature sensor.

Figure 14:
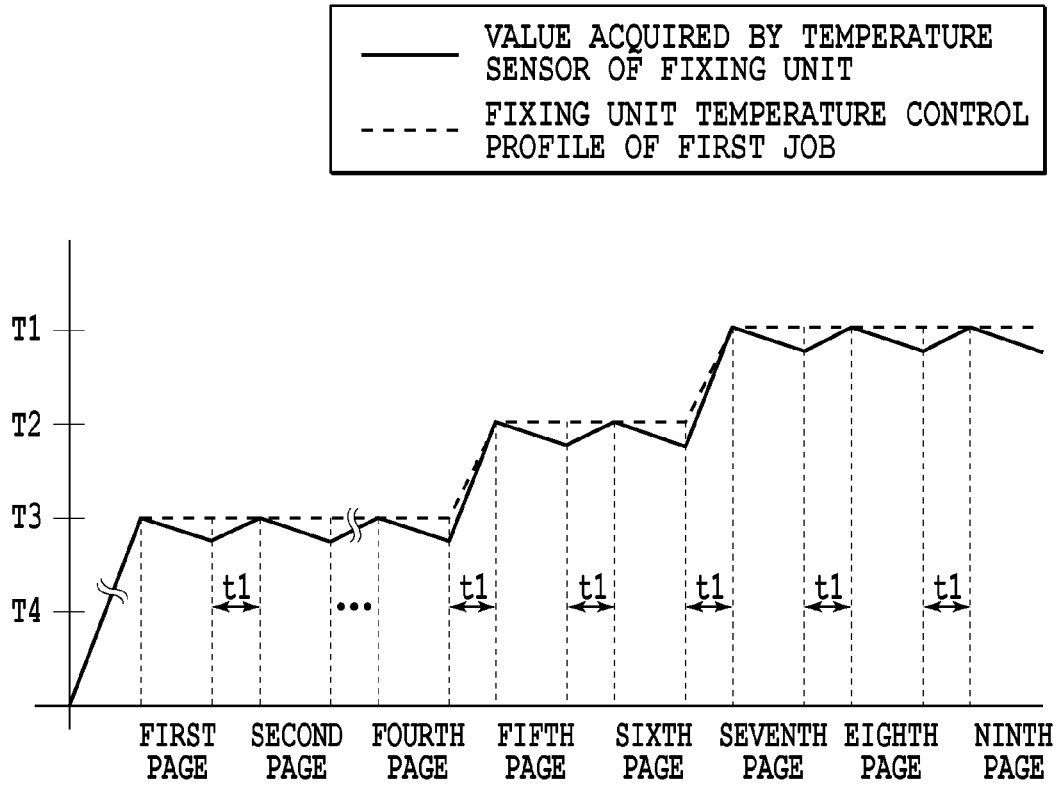
FIG. 14 is a diagram showing an example of temperature values acquired in the second embodiment.
Figure 15:
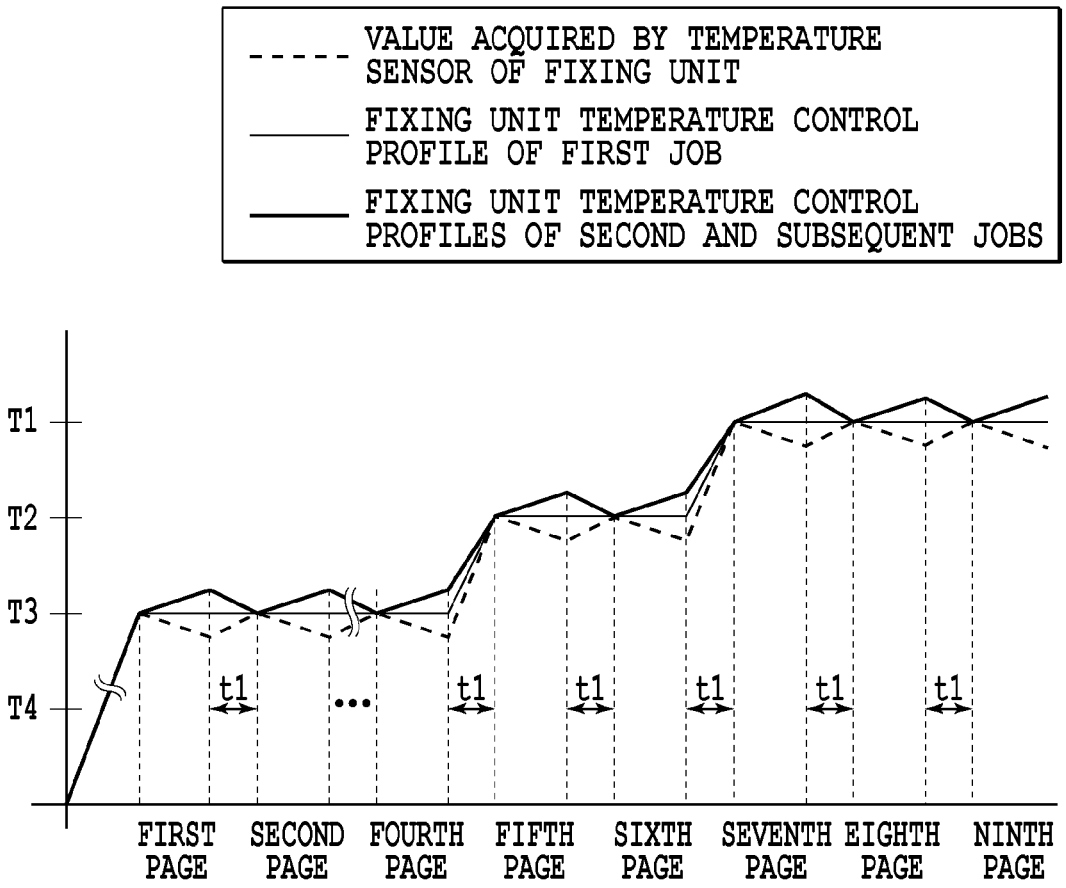
FIG. 15 is a diagram showing an example of a second and the subsequent temperature control profiles in the second embodiment.

Here, FIG. 14 shows an example of the temperature values acquired by the temperature sensor of the fixing unit 326. The temperature values are stored in the fixing unit temperature buffer in the storage unit 205.

When generating the temperature control profiles of the second and the subsequent jobs, the temperature values stored in the fixing unit temperature buffer in the storage unit 205 are considered. Specifically, the difference between the fixing temperature indicated by the temperature control profile used for the first job and the temperature value which is acquired when the first print job is performed and written to the fixing unit temperature buffer in the storage unit 205 is the temperature taken away when the transfer paper passes through the fixing unit. Therefore, the fixing unit temperature fine-tuning unit 1102 generates fixing unit temperature control profiles of the second and the subsequent jobs considering the difference. FIG. 15 shows a state of the fixing unit temperature control profiles of the second and the subsequent jobs. In FIG. 15, the fixing temperatures in the fixing unit temperature control profiles of the second and the subsequent jobs are temperatures obtained by adding correction values to the fixing temperatures in the fixing unit temperature control profile of the first job. Here, the correction value is a value obtained by subtracting the fixing temperature of the fixing unit acquired by the fixing unit temperature acquisition unit 1101 from the fixing temperature in the fixing unit temperature control profile of the first job.

In this way, the fixing temperature of the fixing unit 326 is acquired for each page from the temperature control profile and the correction value is calculated. It is possible to improve the accuracy of printing by applying the temperature control profiles updated by using the correction values to the second and the subsequent print jobs.

The number of the printing modes, the number of the steps used in S604, and the number of continuous pages in S606 are not limited to the numbers described in this description, but can be set to any number.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-217335, filed Sep. 30, 2011, which is hereby incorporated by reference herein in its entirety.

What is claimed is:

1. An image processing apparatus for controlling a fixing temperature of a fixing device which fixes an image to be formed, comprising:

a decision unit configured to determine a fixing temperature corresponding to each page based on a printing mode of each page included in a print job including a plurality of pages;

a determination unit configured to determine whether or not the difference of a temperature which is calculated by subtracting a fixing temperature of an N page determined by the decision unit from a fixing temperature of an N+1 page determined by the decision unit is greater than or equal to a predetermined temperature, wherein N is a natural number; and a controlling unit configured to control the fixing temperature of the N page determined by the decision unit to be lower than the fixing temperature of the N+1 page and higher than the fixing temperature of the N page in a case where the determination unit determines that the difference is greater than or equal to the predetermined temperature.

2. The image processing apparatus according to claim 1, wherein in a case where the determination unit determines that the difference is less than the predetermined temperature, the controlling unit controls the fixing device to use the fixing temperature determined by the decision unit.

3. The image processing apparatus according to claim 1, wherein, in a case where the fixing temperature of the N page determined by the decision unit and the fixing temperature of a N−1 page are the same, the controlling unit controls the fixing temperature of the N−1 page to be lower than the fixing temperature of the N+1 page and higher than the fixing temperature of the N−1 page, where N is also an integer equal to or larger than two.

4. The image processing apparatus according to claim 1, wherein the printing mode includes at least one of a full color high quality printing mode, a full color printing mode, a single color printing mode, and a single color character printing mode.

5. The image processing apparatus according to claim 1, further comprising:

an acquisition unit configured to acquire temperature measurement results of the fixing device in a case where the fixing unit fixes each page of an M-th print job, where M is an integer greater than or equal to one, wherein a difference value between a measured temperature of the fixing device corresponding to each page acquired by the acquisition unit and the fixing temperature corresponding to each page controlled by the controlling unit is obtained for each corresponding page, and wherein a fixing temperature corresponding to each page in a (M+1)-th print job and a subsequent print job is determined by the decision unit decided on the basis of the difference value.

6. The image processing apparatus according to claim 1, further comprising:

in a case where the fixing device fixes an image for multiple copies of a document, a measurement unit configured to measure the temperature of the fixing device at a time of fixing each page of a first copy of the document, and a storage unit configured to store the measured temperature associated with each page as a fixing temperature, wherein the controlling unit calculates a difference value between the fixing temperature stored in the storage unit and a measured temperature measured by the measurement unit, and changes the fixing temperature for each page to a new value obtained by adding the difference value to the fixing temperature.

7. A controlling method for controlling a fixing temperature of a fixing device which fixes an image to be formed in an image processing apparatus, comprising the steps of:

determining in a deciding step a fixing temperature corresponding to each page based on a printing mode of each page included in a print job including a plurality of pages;

determining whether or not the difference of a temperature which is calculated by subtracting a fixing temperature of an N page determined by the deciding step from a fixing temperature of an N+1 page determined by the deciding step is greater than or equal to a predetermined temperature, where N is a natural number; and controlling the fixing temperature of the N page determined by the deciding step to be lower than the fixing temperature of the N+1 page and higher than the fixing temperature of the N page in a case where the determining step determines that the difference is greater than or equal to the predetermined temperature.

8. A non-transitory computer readable storage medium storing a program which causes the fixing device to perform the controlling method according to claim 7.

9. An image processing apparatus for controlling a fixing temperature of a fixing device which fixes an image to be formed, comprising:

an obtaining unit configured to obtain an attribute of each page included in a print job including a plurality of pages; and a controlling unit configured to control the fixing temperature for each page, based on a change of the obtained attribute obtained by the obtaining unit between continuous pages, wherein in a case where there is a change in an attribute between the continuous pages, the controlling unit sets a fixing temperature of a preceding page having a first attribute according to the change closer to the fixing temperature of a following page having a second attribute than the fixing temperature of other pages having the first attribute.

10. The image processing apparatus according to claim 9, wherein in a case where there is no change of an attribute between the continuous pages, the controlling unit sets a fixing temperature of each page based on a fixing temperature set to each attribute.

11. An image processing apparatus for controlling a fixing temperature of a fixing device which fixes an image to be formed, comprising:

an obtaining unit configured to obtain an a printing mode of each page included in a print job including a plurality of pages;

a controlling unit configured to control a fixing temperature for each page, based on a change of the obtained printing mode by the obtaining unit between continuous pages, wherein in a case where there is a change of a printing mode between the continuous pages, the controlling unit sets a fixing temperature of a preceding page associated with a first printing mode according to the change closer to the fixing temperature of a following page associated with a second printing mode than the fixing temperature of other pages associated with the first printing mode.

12. The image processing apparatus according to claim 11, wherein in a case where there is no change of a printing mode between the continuous pages, the controlling unit sets a fixing temperature of each page based on a fixing temperature set to each printing mode.

13. A controlling method for controlling a fixing temperature of a fixing device which fixes an image to be formed in an image processing apparatus, comprising the steps of:

obtaining an attribute of each page included in a print job including a plurality of pages;

controlling a fixing temperature for each page, based on a change of the obtained attribute by the obtaining step between continuous pages, wherein in a case where there is a change of an attribute between the continuous pages, the controlling step includes setting a fixing temperature of a preceding page having a first attribute according to the change closer to the fixing temperature of a following page having a second attribute than the fixing temperature of other pages having the first attribute.

14. A non-transitory computer readable storage medium storing a program which causes the fixing device to perform the controlling method according to claim 13.

15. A controlling method for controlling a fixing temperature of a fixing device which fixes an image to be formed in an image processing apparatus, comprising the steps of:

obtaining an a printing mode of each page included in a print job including a plurality of pages;

controlling a fixing temperature for each page, based on a change of the obtained printing mode by the obtaining step between continuous pages, wherein in a case where there is a change of a printing mode between the continuous pages, the controlling step includes setting a fixing temperature of a preceding page associated with a first printing mode according to the change closer to the fixing temperature of a following page associated with a second printing mode than the fixing temperature of other pages associated with the first printing mode.

* * * * *